US006092718A

United States Patent [19]

Chen et al.

[11] Patent Number: 6,092,718

[45] Date of Patent: Jul. 25, 2000

[54] PAPER LUNCH BOX

[76] Inventors: Ching-Sung Chen; Shen-Pin Lai, both of No. 15, Lane 76, Hotsuo St., Fengyuan City, Taichung County, Taiwan

[21] Appl. No.: 09/477,329

[22] Filed: Jan. 4, 2000

[51] Int. Cl.[7] ..... B65D 25/04

[52] U.S. Cl. ..... 229/120.34; 229/120.33; 229/120.36

[58] Field of Search ..... 229/120.33, 120.34, 229/120.35, 120.36, 120.17; 220/553

[56] References Cited

U.S. PATENT DOCUMENTS

| | | | |
|---|---|---|---|
| 2,123,359 | 7/1938 | Hallmark | 220/553 |
| 2,190,399 | 2/1940 | Burnham | 229/120.36 |
| 2,475,107 | 7/1949 | Newsom | 229/120.34 |
| 2,749,011 | 6/1956 | Lebow | 229/120.33 |
| 3,307,767 | 3/1967 | Humphrey et al. | 229/120.34 |
| 4,632,251 | 12/1986 | Sheffer | 229/120.34 |

*Primary Examiner*—Gary E. Elkins
*Attorney, Agent, or Firm*—Rosenberg, Klein & Lee

[57] ABSTRACT

A paper lunch box includes a box body, at least one longitudinal partition member and at least one transverse partition members respectively installed in the box body to support the box body in shape and to separate the holding space of the box body into separated compartments, the box body being formed of a patterned cardboard folded up into a rectangular container having vertical peripheral walls of double-layer construction, the transverse and longitudinal partition members being formed of a respective patterned cardboard, each having a ∩-like cross section and reinforcing end flaps for mounting.

1 Claim, 8 Drawing Sheets

PAPER LUNCH BOX

BACKGROUND OF THE INVENTION

The present invention relates to a paper lunch box, and more particularly to such a paper lunch box, which has multiple compartments for holding different food and vertical peripheral walls of double-layer design.

FIG. 1 shows a conventional paper lunch box. This structure of paper lunch box 1 comprises a base panel 2, four vertical side panels 3, and four rim flaps 4. Because the holding space of the paper lunch box 1 is an open space, different food cannot be separately kept in the paper lunch box 1. Further, because the vertical side panels 3 are of a single layer design, the paper lunch box 1 tends to be deformed. FIGS. 2A and 2B show another structure of paper lunch box according to the prior art. This structure of paper lunch box is formed of a patterned cardboard 10. The patterned cardboard 10 comprises bottom panels 11, 12 and 13, side panels 110, 111, 112, 113, 114, 115 and 116, partition panels 120, 121 and 123, and extension flaps 14. After the patterned cardboard 10 has been folded up and adhered into shape, the finished paper lunch box provide three separated compartments for holding different food. However, this structure of paper lunch box still has drawbacks as outlined hereinafter.

1. Because the side panels 110, 111, 112, 113, 114, 115 and 116 are of a single-layer construction, the paper lunch box is not very strong for carrying much food.
2. The paper lunch box provides only a limited number of compartments for holding different food.
3. The partition panels 120, 121 and 123 cannot support the side panels 110, 111, 112, 113, 114, 115 and 116 firmly in shape when the paper lunch box receives a compressive force.

SUMMARY OF THE INVENTION

It is one object of the present invention to provide a paper lunch box, which has a strong structural strength. It is another object of the present invention to provide a paper lunch box, which provides multiple separated compartments for holding different food. According to the present invention, the paper lunch box comprises a box body, at least one longitudinal partition member and at least one transverse partition members respectively installed in the box body to support the box body in shape and to separate the holding space of the box body into separated compartments, the box body being formed of a patterned cardboard folded up into a rectangular container having vertical peripheral walls of double-layer construction, the transverse and longitudinal partition members being formed of a respective patterned cardboard, each having a ∩-like cross section and reinforcing end flaps for mounting.

DETAILED DESCRIPTION OF THE PREFERRED EMBODIMENT

Figure 1:
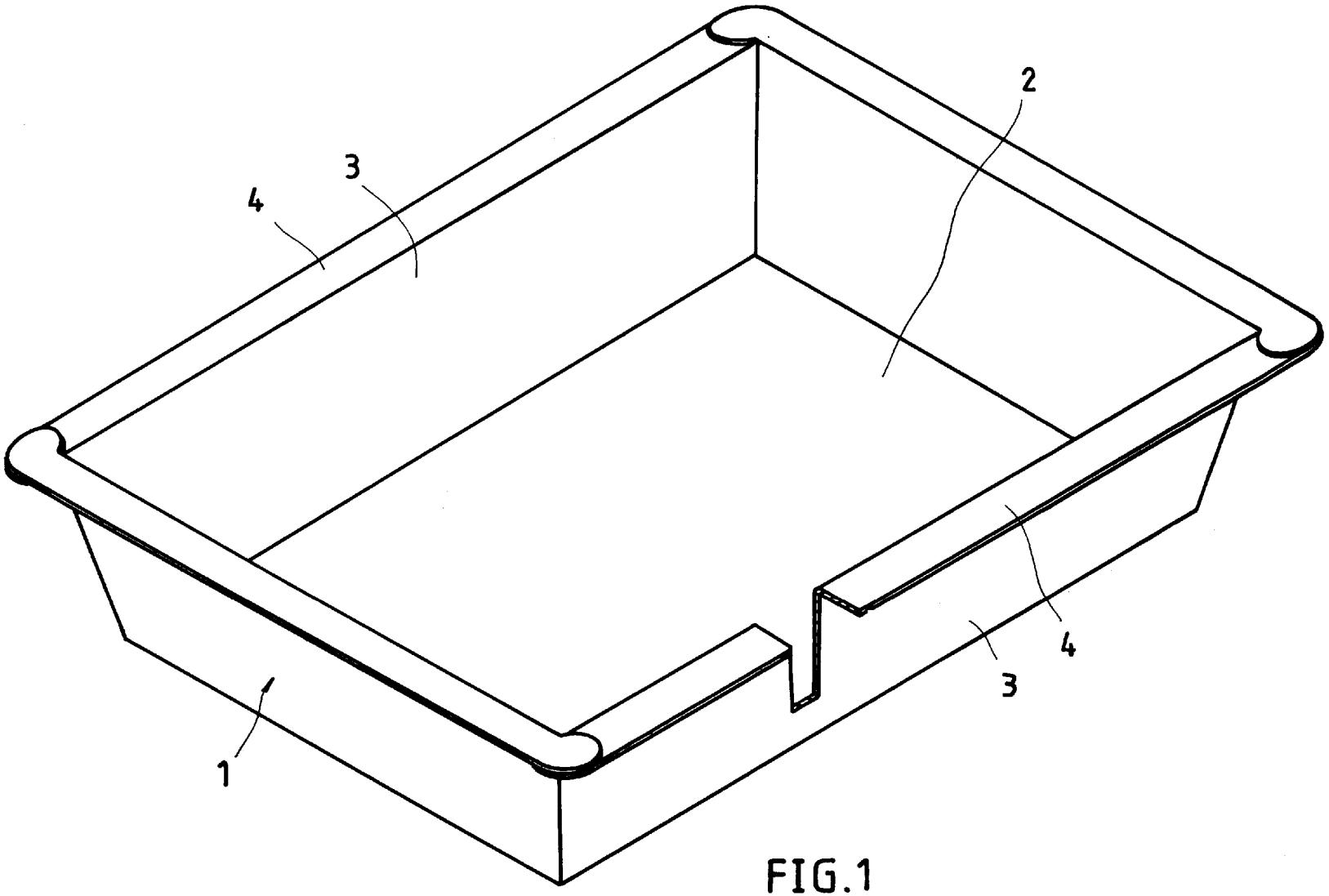
FIG.1 PRIOR ART
FIG. 1 is an elevational view of a paper lunch box according to the prior art.
Figure 2B:
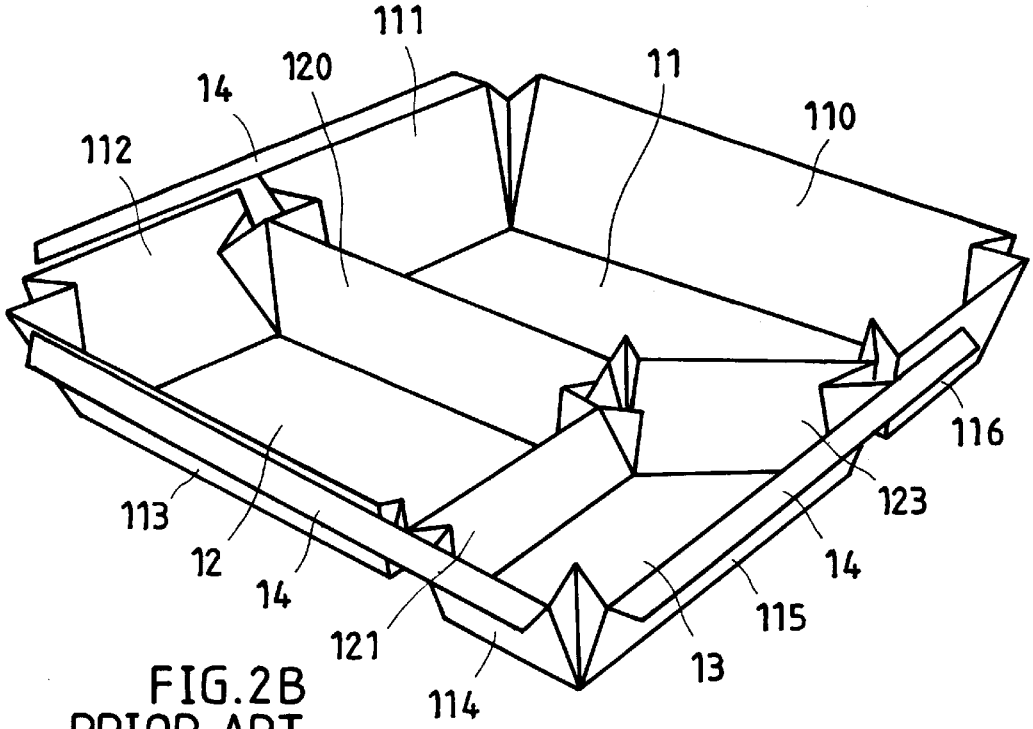
FIG.2B PRIOR ART
FIG. 2B is an assembly view of the paper lunch box shown in FIG. 2A.
Figure 2A:
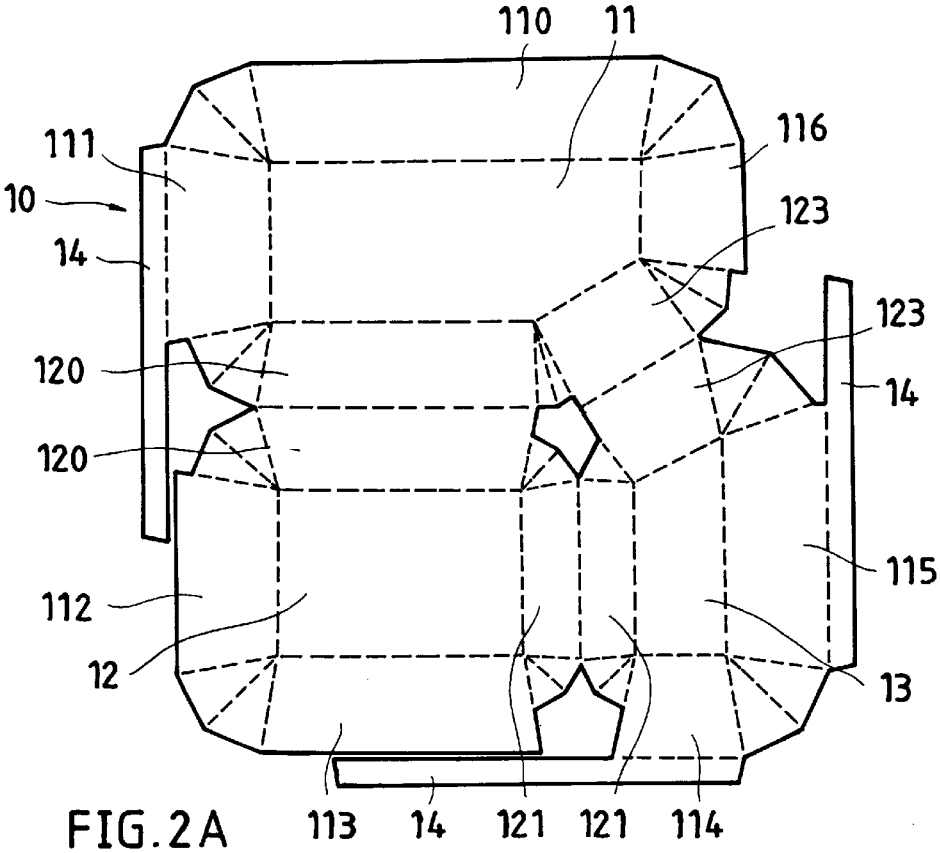
FIG.2A PRIOR ART
FIG. 2A is an extended-out view of another structure of paper lunch box according to the prior art.
Figure 3:
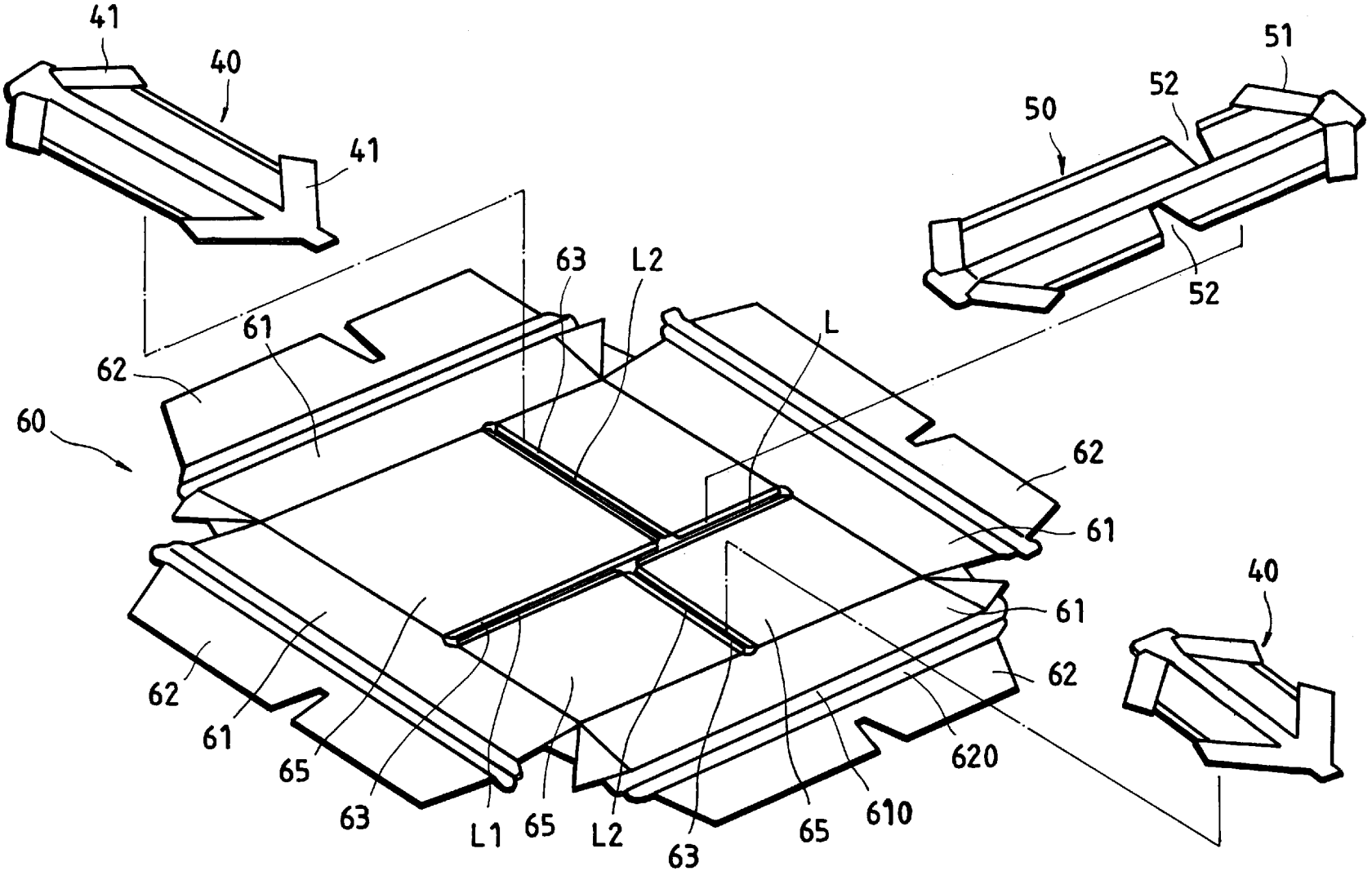
FIG. 3 is an exploded, extended out view of a paper lunch box according to one embodiment of the present invention.
Figure 4:
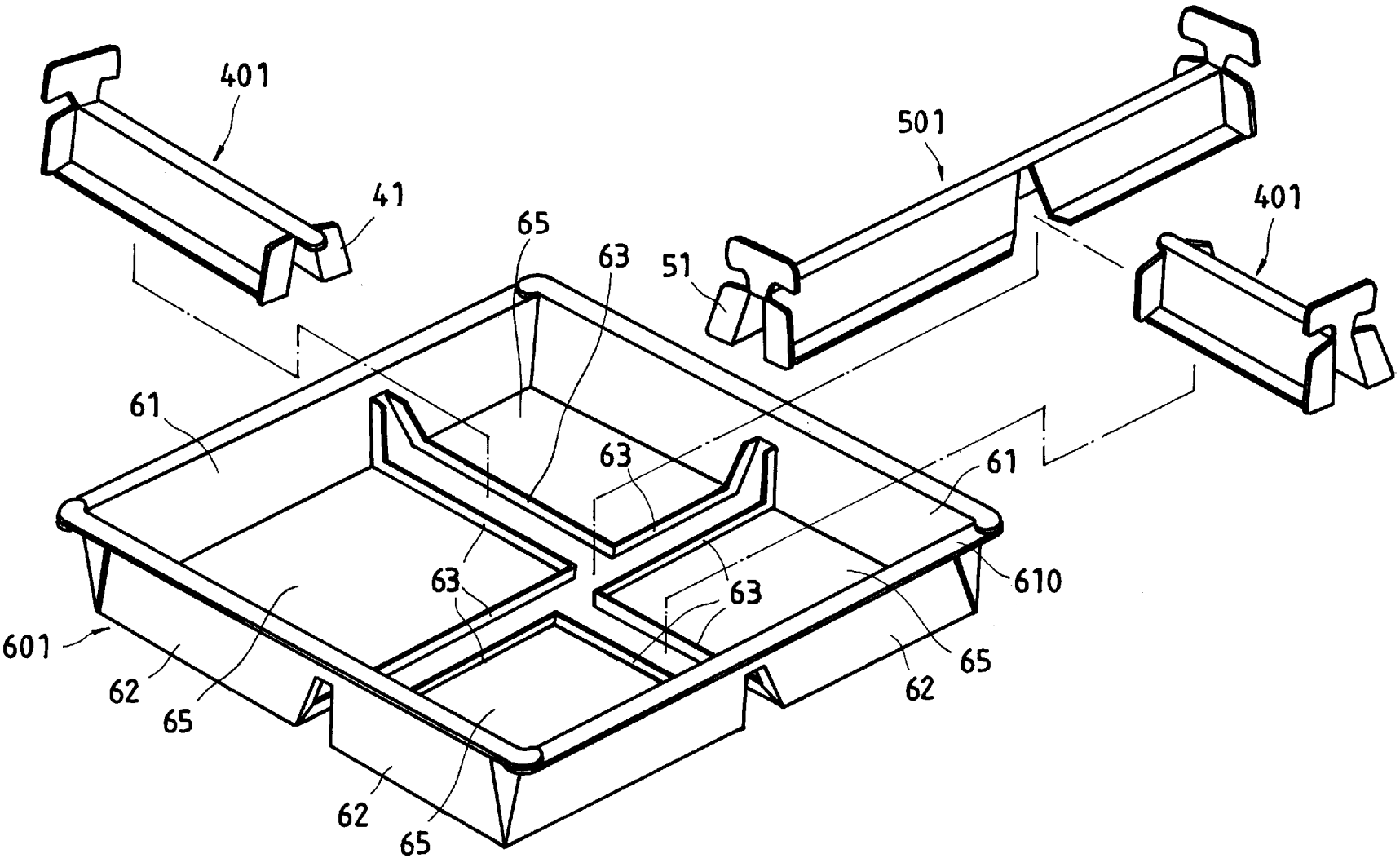
FIG. 4 is similar to FIG. 3 but showing the patterned cardboard for box body assembled.
Figure 5:
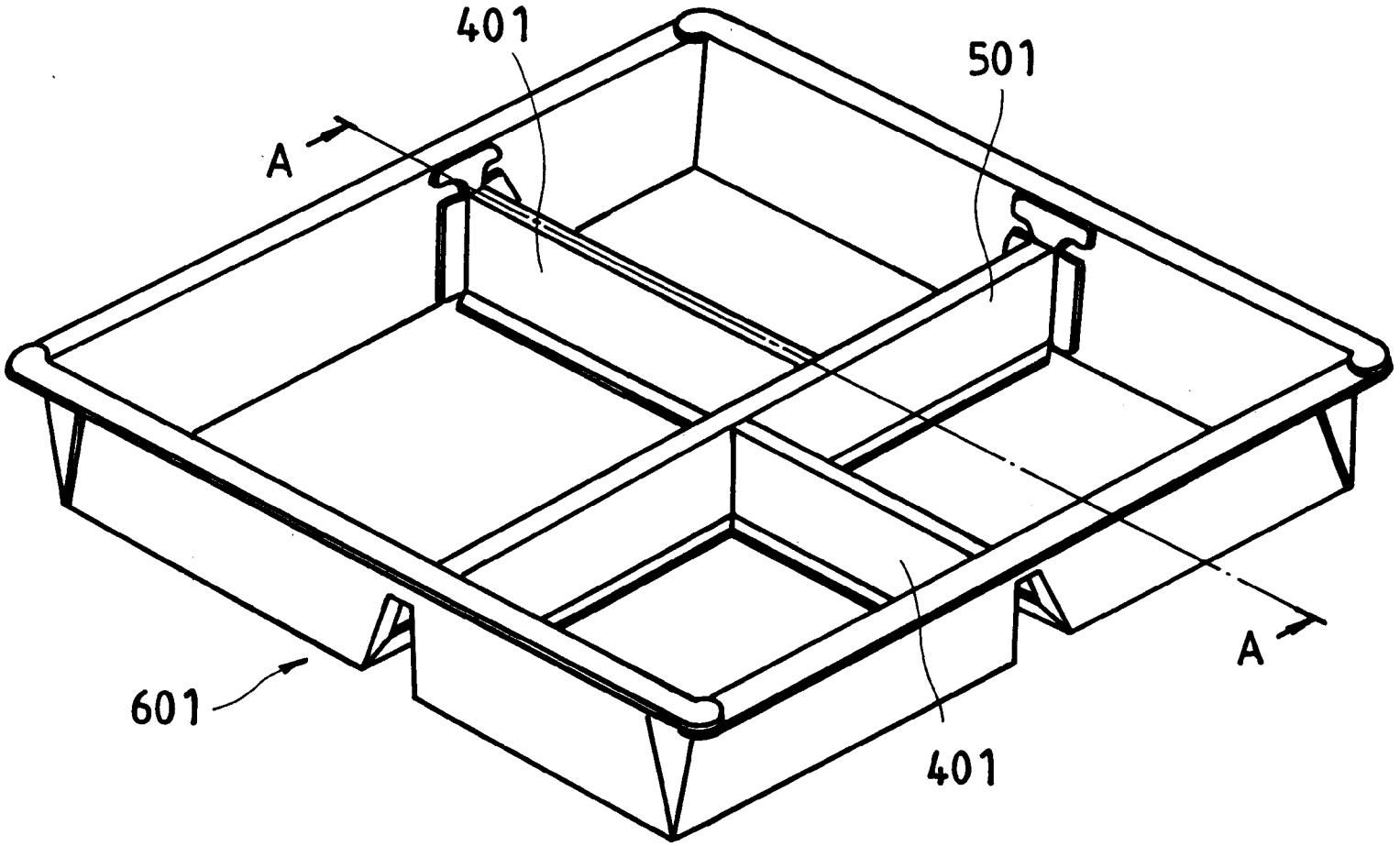
FIG. 5 is an elevational view of the paper lunch box shown in FIG. 3.
Figure 6:
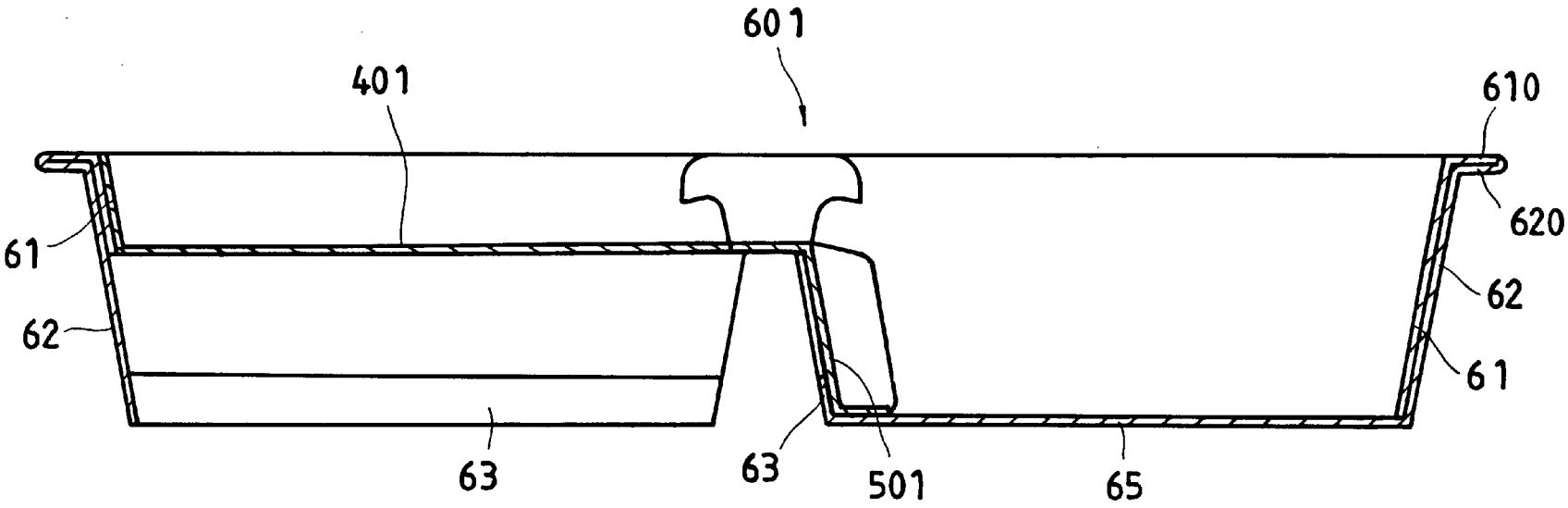
FIG. 6 is a sectional view taken along line A—A of FIG. 5.

Referring to FIGS. from 3 through 6, a paper lunch box in accordance with the present invention is shown comprised of a box body 601, two transverse partition members 401, and a longitudinal partition member 501. The box body 601, the transverse partition members 401 and the longitudinal partition member 501 are made of respective patterned cardboards 60, 40 and 50. The patterned cardboards 60, 40 and 50 are bent into shape and adhered together. The transverse partition members 401 and the longitudinal partition member 501 each have a ∩-like cross section. The longitudinal partition member 50 (501) comprises two locating notches 52 at two opposite lateral sides, and reinforcing end flaps 51 at two opposite ends. The transverse partition members 40 (401) each comprise a plurality of reinforcing end flaps 41 at two opposite ends. The box body 60 (601) comprises a rectangular base panel 65, four side panels 61 respectively extended from the four sides of the base panel 65, four peripheral reinforcing panels 62 respectively extended from the side panels 61, four inner rim portions 610 respectively connected between the side panels 61 and the reinforcing panels 62, four outer rim portions 620 respectively connected between the inner rim portions 610 and the reinforcing panels 62, a longitudinal line of cut L1 formed on the base panel 65, two transverse lines of cut L2 respectively formed on the base panel 65 and perpendicularly extended from the longitudinal line of cut L1 in reversed directions, and reinforcing strip portions 63 respectively formed integral with the base panel 65 along two opposite sides of each of the lines of cut L1 and L2. After the patterned cardboard 60 having been folded up, the reinforcing panels 62 are respectively adhere to the side panels 61, and the outer rim portions 620 are respectively adhered to the inner rim portions 610 (see FIG. 4), and then the longitudinal partition member 501 and the transverse partition members 40 (401) are respectively adhered to the reinforcing strip portions 63 and side panels 61 of the box body 601. When installed, the reinforcing end flaps 51 of the longitudinal partition member 501 are adhered to two opposite side panels 61 of the box body 601 on the inside, the reinforcing end flaps 41 of the transverse partition members 401 are respectively adhered to one corresponding side panel 61 of the box body 601 and the inside wall of the longitudinal partition member 501 around the locating notches 52.

Because the partition members 401 and 501 have a substantially ∩-like cross section and are used as stretcher means to support the side panels 61 of the box body 601 in shape, the structure of the lunch box is strong. Because the reinforcing panels 62 are respectively adhere to the side panels 61 and the outer rim portions 620 are respectively adhered to the inner rim portions 610, the vertical peripheral walls of the paper lunch box have a double-layer construction, which is strong enough against deformation. Further, the partition members 40 and 50 separate the holding space of the paper lunch box into separated compartments for holding different food.

Figure 7:
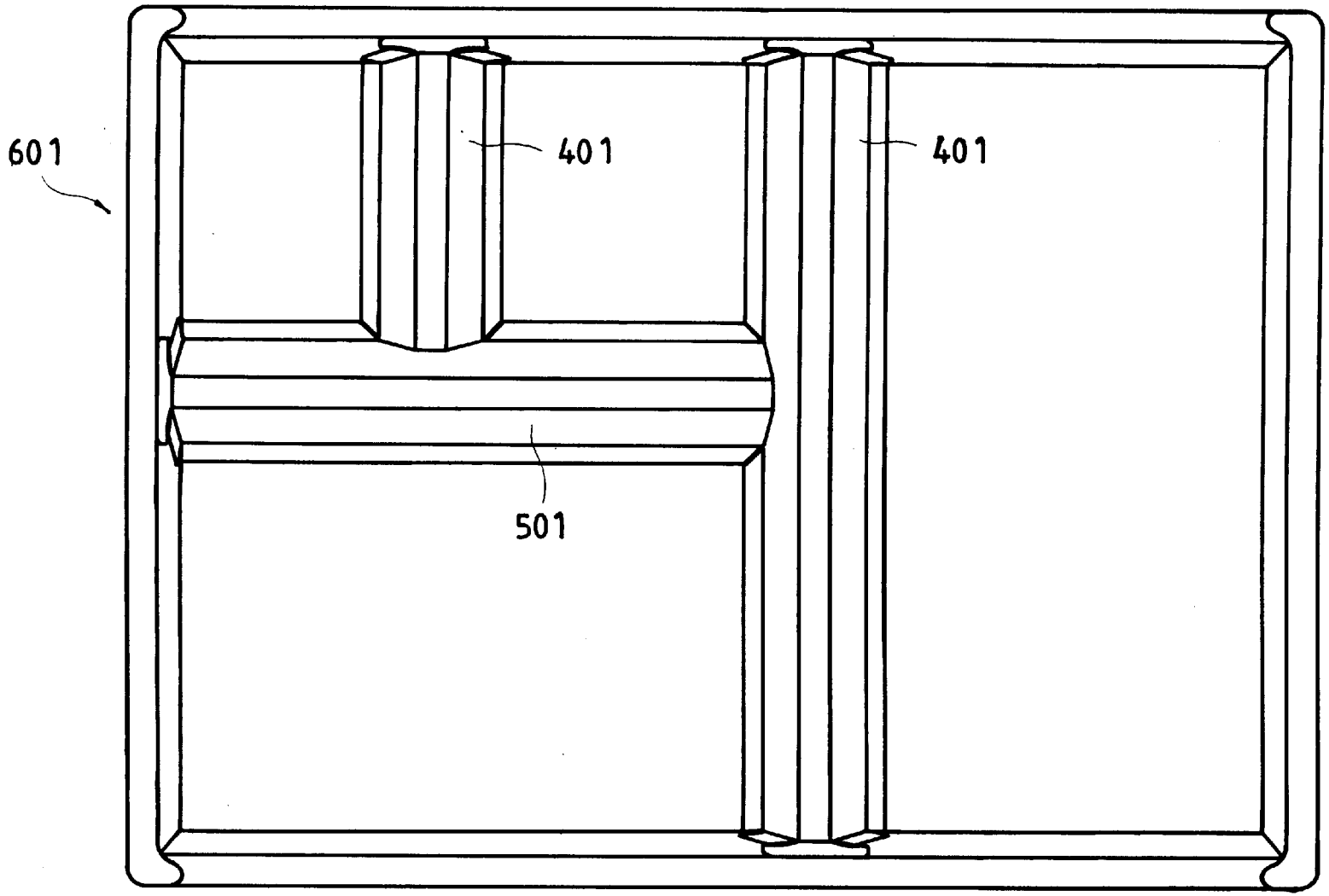
FIG. 7 is a top view of an alternate form of the present invention.
Figure 8:
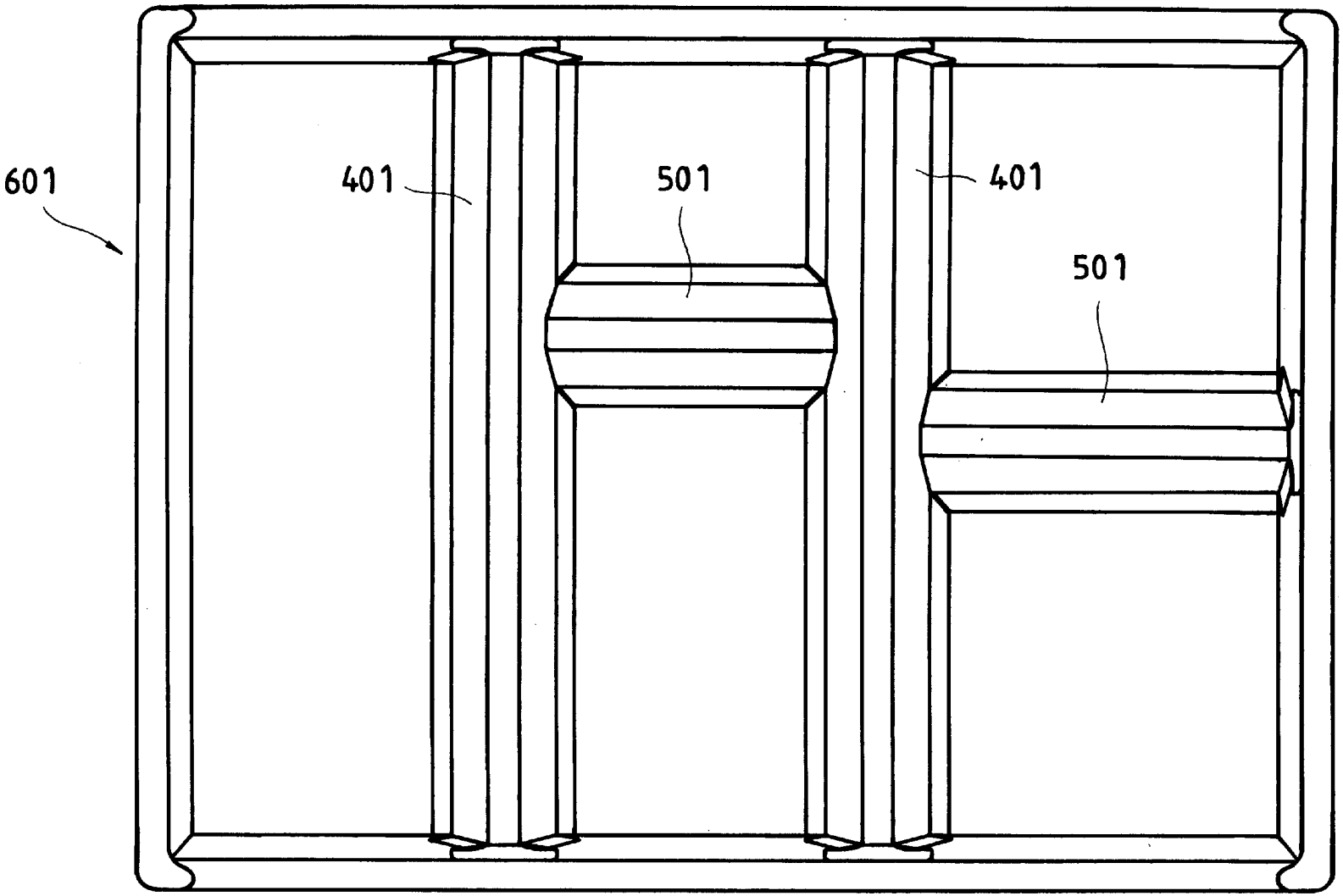
FIG. 8 is a top view of another alternate form of the present invention.

FIGS. 7 and 8 show two alternate forms of the present invention. In FIG. 7, the transverse partition members 401 have different lengths, the longitudinal partition member 501 is connected between the longer transverse partition member 401 and one side panel of the box body 601, and the shorter transverse partition member 401 is connected between the longitudinal partition member 501 and one side panel of the box body 601. In FIG. 8, two transverse partition members 401 and two longitudinal partition members 501 are installed in the box body 601.

It is to be understood that the drawings are designed for purposes of illustration only, and are not intended for use as a definition of the limits and scope of the invention disclosed.

What the invention claimed is:

1. A paper lunch box comprising:

a box body formed of a patterned cardboard, the patterned cardboard for said box body comprising a rectangular base panel, four side panels respectively extended from the four sides of said rectangular base panel, four peripheral reinforcing panels respectively adhered to said side panels at an outer side, four inner rim portions respectively connected between said side panels and said peripheral reinforcing panels, four outer rim portions respectively connected between said inner rim portions and said peripheral reinforcing panels and respectively adhered to said inner rim portions, at least one longitudinal line of cut respectively formed on said base panel, at least one transverse lines of cut respectively formed on said base panel and perpendicularly extended from said longitudinal line of cut, and reinforcing strip portions respectively formed integral with said base panel along two opposite sides of each of said at least one longitudinal line of cut and said at least one transverse line of cut;

at least one transverse partition member respectively formed of a patterned cardboard and adhered to said reinforcing strip portions of said box body along said at least one transverse line of cut, said at least one transverse partition member each having a ∩-like cross section, and reinforcing end flaps for mounting; and at least one longitudinal partition member respectively formed of a patterned cardboard and adhered to said reinforcing strip portions of said box body along said at least one longitudinal line of cut and connected to said at least one transverse partition member at right angles, said at least one longitudinal partition member each having a ∩-like cross section, and reinforcing end flaps for mounting.

* * * * *